US010188900B2

(12) United States Patent
Tung

(10) Patent No.: US 10,188,900 B2
(45) Date of Patent: Jan. 29, 2019

(54) EXTENSION BASE FOR EXERCISE APPARATUS

(71) Applicant: SINGULARITY LTD., Belize (BZ)

(72) Inventor: Chia Lin Tung, Taichung (TW)

(73) Assignee: BH Asia Hong Kong Holding Co., Limited, Taichung (TW)

( * ) Notice: Subject to any disclaimer, the term of this patent is extended or adjusted under 35 U.S.C. 154(b) by 148 days.

(21) Appl. No.: 15/364,722

(22) Filed: Nov. 30, 2016

(65) Prior Publication Data

US 2018/0147441 A1 May 31, 2018

(51) Int. Cl.

| | |
|---|---|
| ***A63B 22/00*** | (2006.01) |
| ***A63B 21/22*** | (2006.01) |
| ***A63B 22/06*** | (2006.01) |

(52) U.S. Cl.

CPC ..... *A63B 22/0046* (2013.01); *A63B 21/225* (2013.01); *A63B 22/0664* (2013.01); *A63B 2022/067* (2013.01)

(58) Field of Classification Search

None

See application file for complete search history.

(56) References Cited

U.S. PATENT DOCUMENTS

| | | | | |
|---|---|---|---|---|
| 4,620,701 | A * | 11/1986 | Mojden | A63B 3/00 482/142 |
| 4,961,570 | A * | 10/1990 | Chang | A63B 22/0056 482/53 |
| 5,556,064 | A * | 9/1996 | Cowe | F16M 11/24 248/172 |
| 6,648,358 | B2 * | 11/2003 | Catanescu | A61G 5/10 280/304.1 |
| 6,994,618 | B1 * | 2/2006 | Syers | A22B 5/06 452/187 |
| 8,657,130 | B2 * | 2/2014 | Thrush | A47F 5/08 211/117 |
| 2005/0130814 | A1 * | 6/2005 | Nitta | A63B 1/00 482/121 |

* cited by examiner

*Primary Examiner* — Stephen R Crow
(74) *Attorney, Agent, or Firm* — Rosenberg, Klein & Lee

(57) ABSTRACT

An extension base for an exercise apparatus includes a stationary seat that is attached to a bottom of a frame of the exercise apparatus and defines therein a channel; and two extension legs that are inserted into the channel of the stationary seat from two openings at two ends of the stationary seat, so that the extension legs can be extended or retracted with respect to the stationary seat. When the extension legs are fully retracted into the stationary seat, a distance between the outer ends of the two extension legs farthest away from each other is still long enough to support the elliptical exerciser and prevent it from falling. The extension base solves the problem that the conventional exercise apparatus tends to rollover when its base is removed.

5 Claims, 8 Drawing Sheets

EXTENSION BASE FOR EXERCISE APPARATUS

BACKGROUND OF THE INVENTION

1. Technical Field

The present invention relates to exercise apparatuses, and more particularly to an extension base designed for exercise apparatuses.

2. Description of Related Art

Conventional exercise apparatuses, such as elliptical exercisers or exercise bikes (also referred to as spin bikes), usually have a frame carrying thereon a flywheel, cranks connected to the flywheel at two sides, and treadles attached to the cranks for a user to tread. When the two treadles are threaded, the flywheel generates resistance, so the user can exercise his/her body by treading the two treadles.

FIG. 8 depicts an existing base 91 for exercise apparatuses, which is attached to the bottom of a frame 92 of an exercise apparatus. The base 91 is in the form of a long bar with a fixed length transversely affixed to the frame 92 for enabling the frame 92 to stand firmly in use. Thus, the base 91 has to be long enough for this purpose. However, when such an exercise apparatus is packed in its packaging case for the manufacturer's shipment or the user's storage, the base 91 usually much longer than the frame 92 and wider than the case has to be disassembled form the frame 92 and stored separately in the case. Taking shipment for example, when such an exercise apparatus is delivered to a customer, installation performed by a technician dispatched by the manufacture is required to attach the base 91 to the frame 92, which is time-consuming and labor-demanding. Besides, the frame 92 when received in the case for shipment is often arranged as standing upright, and thus tends to rollover as it loses the support of the base 91.

SUMMARY OF THE INVENTION

The primary objective of the present invention is to solve the problem seen in the prior art that an exercise apparatus tends to rollover when it loses the support from its base 91 that is removed by providing an extension base for exercise apparatuses. The extension base has two extension legs that can be extended and retracted with respect to a stationary seat of an exercise apparatus. Even when the extension legs are fully retracted, a distance between the outer ends of the two extension legs away from each other is still long enough to support the elliptical exerciser and prevent it from falling, thereby preventing the exercise apparatus standing upright in the packaging case from rollover.

The exercise apparatus has a frame that carries a flywheel for providing loading, and two treadles connected to the flywheel from two sides through respective cranks, so that when the two treadles are treaded, the flywheel provides resistance. The disclosed extension base comprises:

a stationary seat, being attached to a bottom of the frame, and being of a tubular structure that has a channel and has openings at two ends of the channel; and two extension legs, each having an appropriate length and being inserted into the channel from the two opening, respectively, so that the extension legs can be symmetrically extended and retracted with respect to the stationary seat, wherein when the extension legs are fully retracted into the stationary seat, a distance between outer ends of the two extension legs farthest away from each other is still long enough to support the elliptical exerciser and prevent the elliptical exerciser from falling.

Therein, each of the extension legs has a slot in a segment thereof retractable into the channel. The slot extends in a direction parallel to a direction in which the extension leg moves. The stationary seat has two retaining portions corresponding to the slots of the extension legs. Extension of the extension legs with respect to the stationary seat is limited by retaining portions moving in the slots, so as to prevent the extension legs from leaving the stationary seat.

Therein, the distance between the outer ends of the two extension legs farthest away from each other when the extension legs are fully retracted into the stationary seat is smaller than or equal to a distance between outer ends of the two treadles farthest away from each other.

Therein, the stationary seat have two positioning pins corresponding to the two extension legs inserted therein, and the positioning pins position the corresponding extension legs at an extended or retracted position of the extension legs so as to retain the extension legs to the stationary seat.

Therein, each of the positioning pins is a pull pin, which comprises a trunk, a spring member contained in the trunk, and a pin biased by the spring member. The trunk is configured to combined with the stationary seat and make the pin biased by the spring member push an end portion thereof into the channel, so that the pin is inserted in one of positioning holes formed on the extension leg until the pin is pulled out and leaves that positioning hole.

Therein, the trunk of each of the pins is externally combined with a knob, in which when the pin associated thereto is received in one of the positioning holes, the knob is configured to be screwedly engaged with the trunk so as to make the pin stay in the positioning hole and prevent the pin from unintentionally pulling up, and when the knob is unscrewed from the trunk, the pin is no longer be retained and can be pulled out.

DETAILED DESCRIPTION OF THE INVENTION

The exemplificative embodiments of the present invention depicted in FIG. 1 through FIG. 7 are illustrative and form no limitations to the scope of the present invention.

The present invention provides an extension base for an exercise apparatus. The exercise apparatus as shown is an elliptical exerciser for example. According to FIG. 1, a frame 1 has a flywheel 11 for providing loading, and two treadles 13 are connected to the flywheel 11 from two sides through respective cranks 12, so that when the two treadles 13 are treaded, the flywheel 11 provides resistance. With the foregoing configuration, a user can exercise his/her body by treading the two treadles 13.

Figure 1:
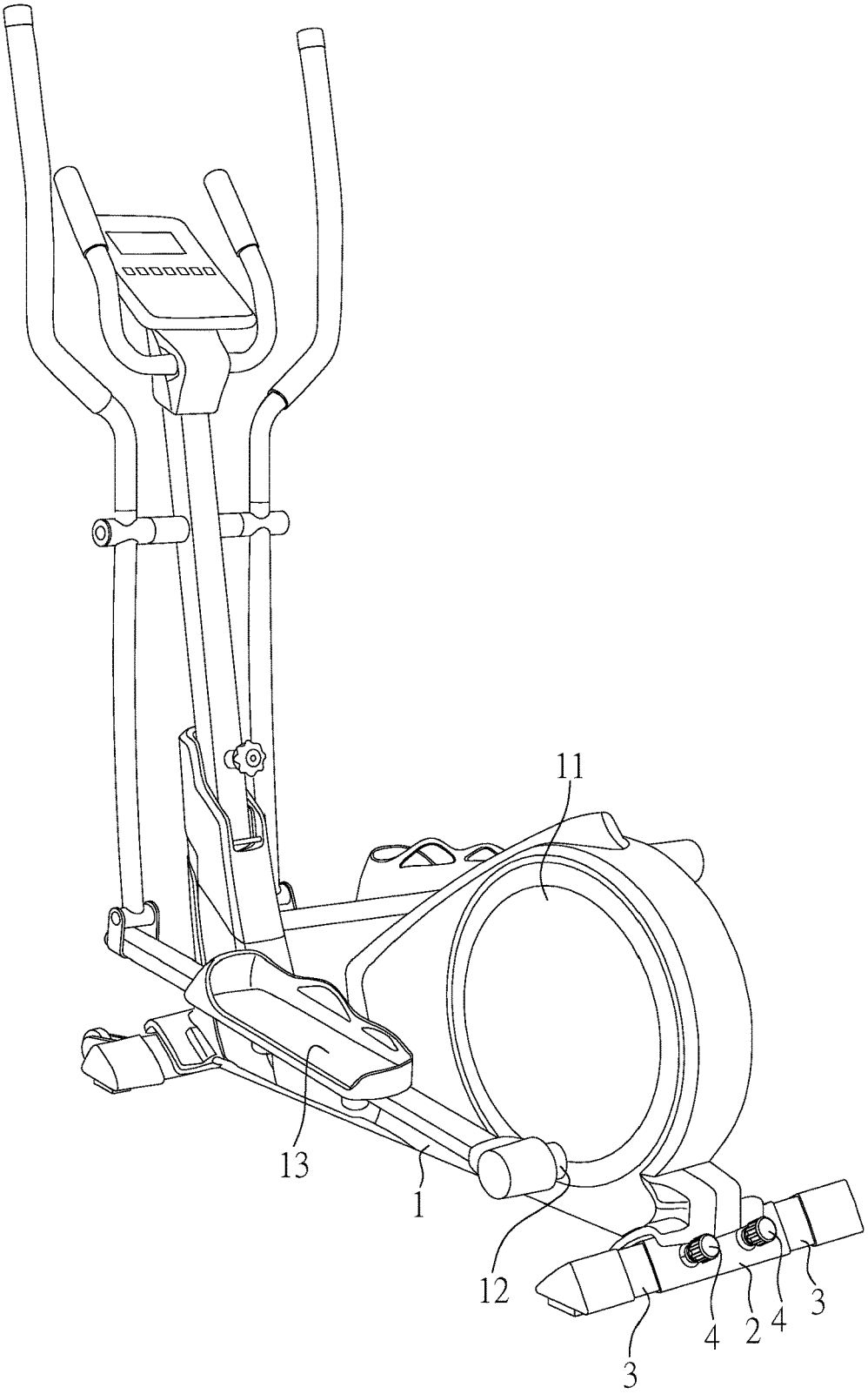
FIG. 1 is a perspective view of an elliptical exerciser according to a first embodiment of the present invention.
Figure 2:
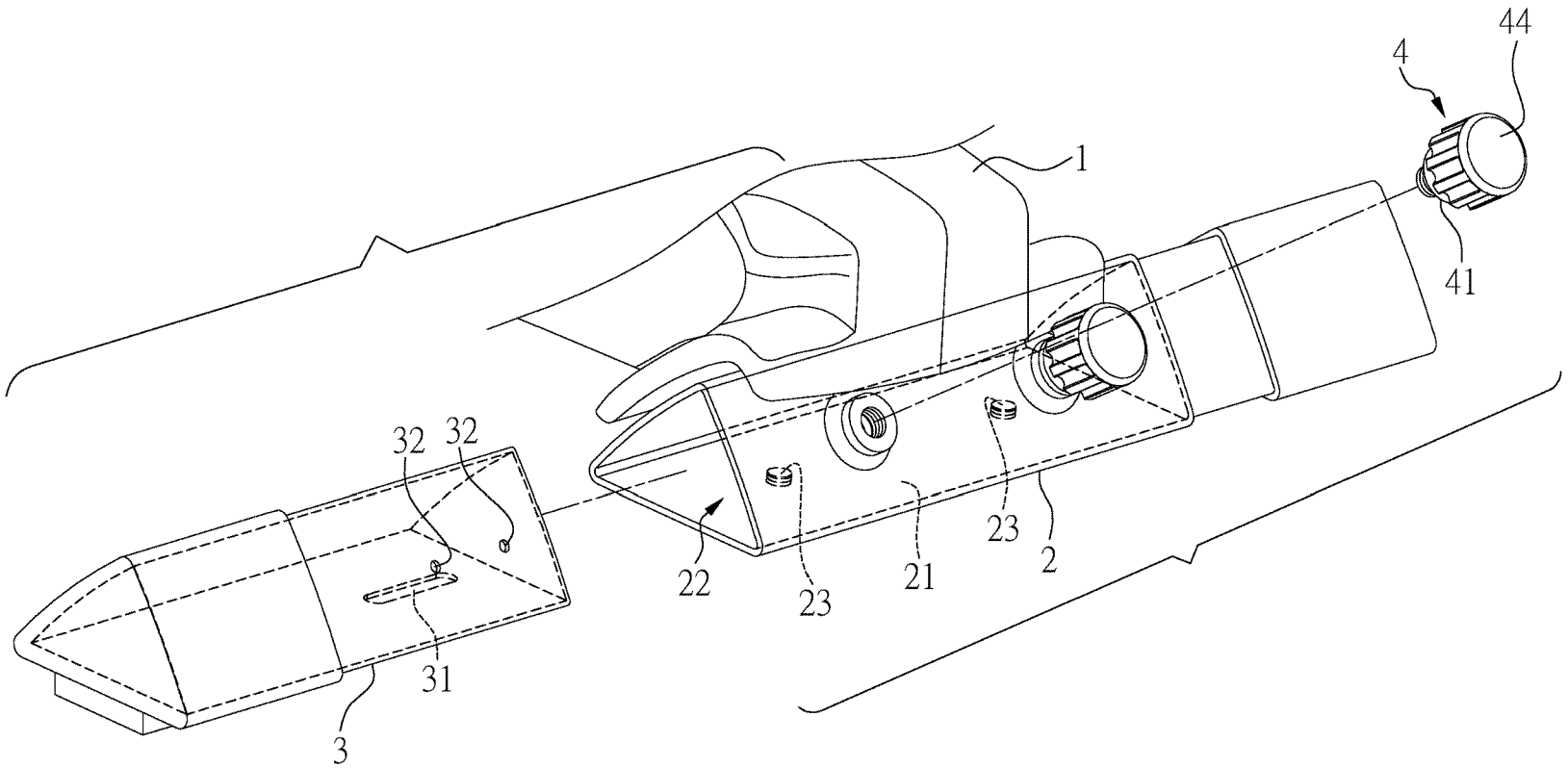
FIG. 2 is an exploded view of an extension base of the first embodiment of the present invention.
Figure 3:
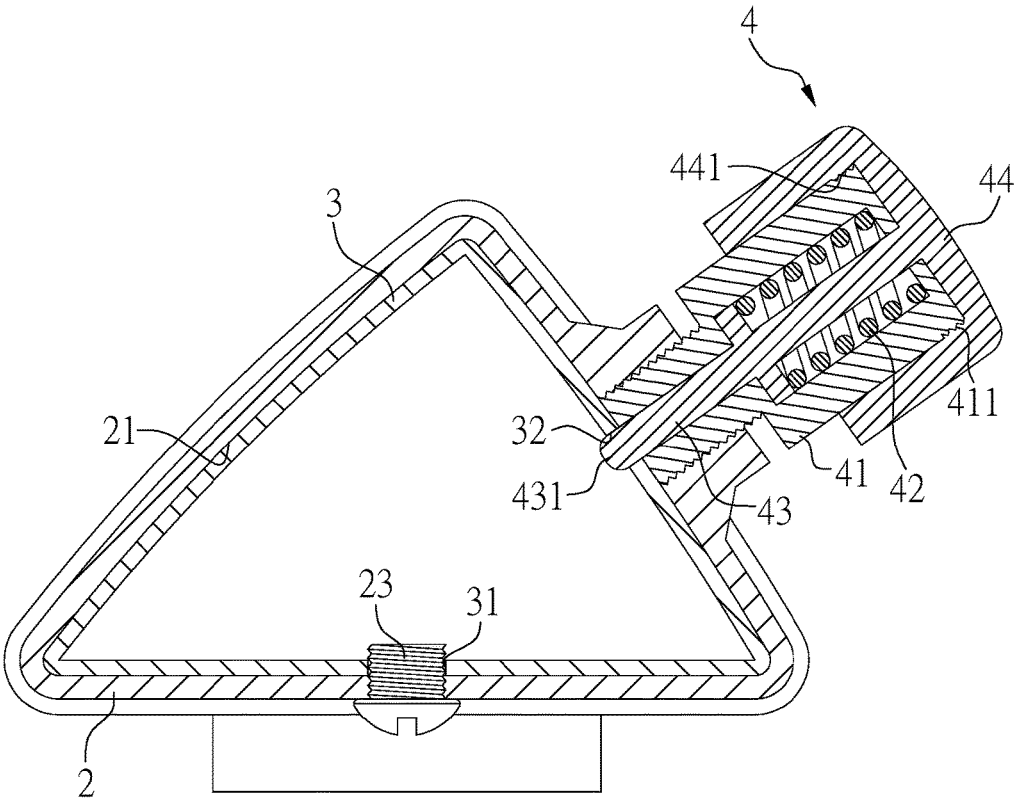
FIG. 3 is a widthwise, vertical cross-sectional view of the extension base of the first embodiment of the present invention taken at a positioning pin.

As shown in FIGS. 2 through 3, the extension base includes a stationary seat 2 and two extension legs 3. The stationary seat 2 is attached to the bottom of the frame 1. The stationary seat 2 is of a tubular structure that has a channel 21 and has openings 22 at two ends of the channel 21. The two extension legs 3 each have an appropriate length and are inserted into the channel 21 from the two opening 22, respectively, so that the extension legs 3 can be symmetrically extended and retracted with respect to the stationary seat 2. When the extension legs 3 are fully retracted into the stationary seat 2, a distance between the outer ends of the two extension legs 3 farthest away from each other is still long enough to support the elliptical exerciser and prevent it from falling.

Figure 4:
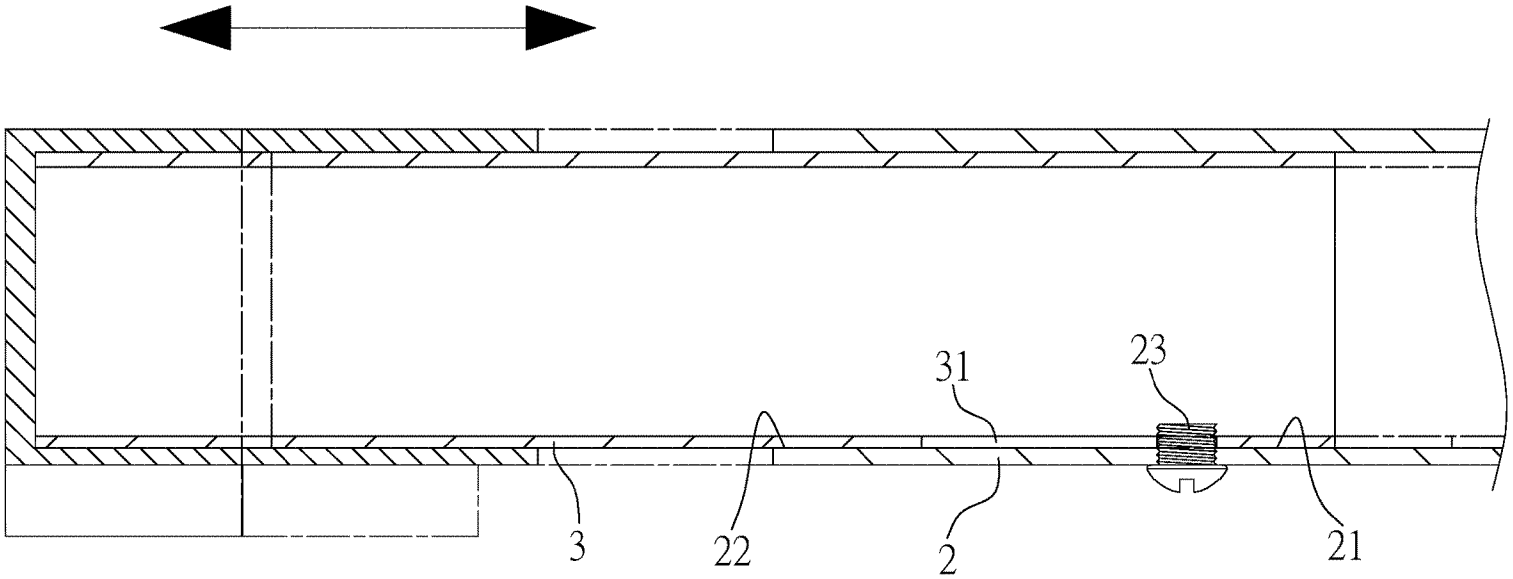
FIG. 4 is a lengthwise, vertical cross-sectional view of the extension base of the first embodiment of the present invention taken at a slot, showing a retaining portion engaged in the slot of an extension leg and the extension leg moving for extension and retraction with respect to a stationary seat.

As shown in FIGS. 2 through 4, in the present embodiment, each of the extension legs 3 has a slot 31 in its segment retractable into the channel 21. The slot 31 extends in a direction parallel to the direction in which the extension leg 3 moves. The stationary seat 2 has two retaining portions 23 corresponding to the slots 31 of the extension legs 3. The extent to which the extension leg 3 stretches out the stationary seat 2 is limited by a retaining portion 23 moving in the slot 31, so as to prevent the extension leg 3 from leaving the stationary seat 2.

As shown in FIGS. 1 through 3 and FIG. 5, in the present embodiment, the stationary seat 2 have two positioning pins 4 corresponding to the two extension legs 3 inserted therein. The positioning pin 4 positions the corresponding extension leg 3 at its extended or retracted position with respect to the stationary seat 2. Preferably, each of the positioning pins 4 is a pull pin, which comprises a trunk 41, a spring member 42 contained in the trunk 41 and a pin 43 biased by the spring member 42. The trunk 41 is configured to combined with the stationary seat 2 and make the pin 43 biased by the spring member 42 push its end portion 431 into the channel 21, so that the pin 43 is inserted in one of positioning holes 32 formed on the extension leg 3 until it is pulled out and leaves the positioning hole 32.

Furthermore, the trunk 41 of each of the pins 43 is externally combined with a knob 44. The knob 44 has internal threads 441 matching external threads 411 formed on the trunk 41. The knob 44 has its internal threads 441 screwedly engaged with the external threads 411 of the trunk 41 so as to make the pin 43 stay in the positioning hole 32 and prevent it from unintentionally pulling up. At this time, the extension leg 3 is locked from moving in and out the stationary seat 2 for extension or retraction. When the knob 44 is unscrewed from the trunk 41, the pin 43 is not retained and can be pulled out, so as to allow the extension leg 3 to extend or retract with respect to the stationary seat 2.

Figure 5:
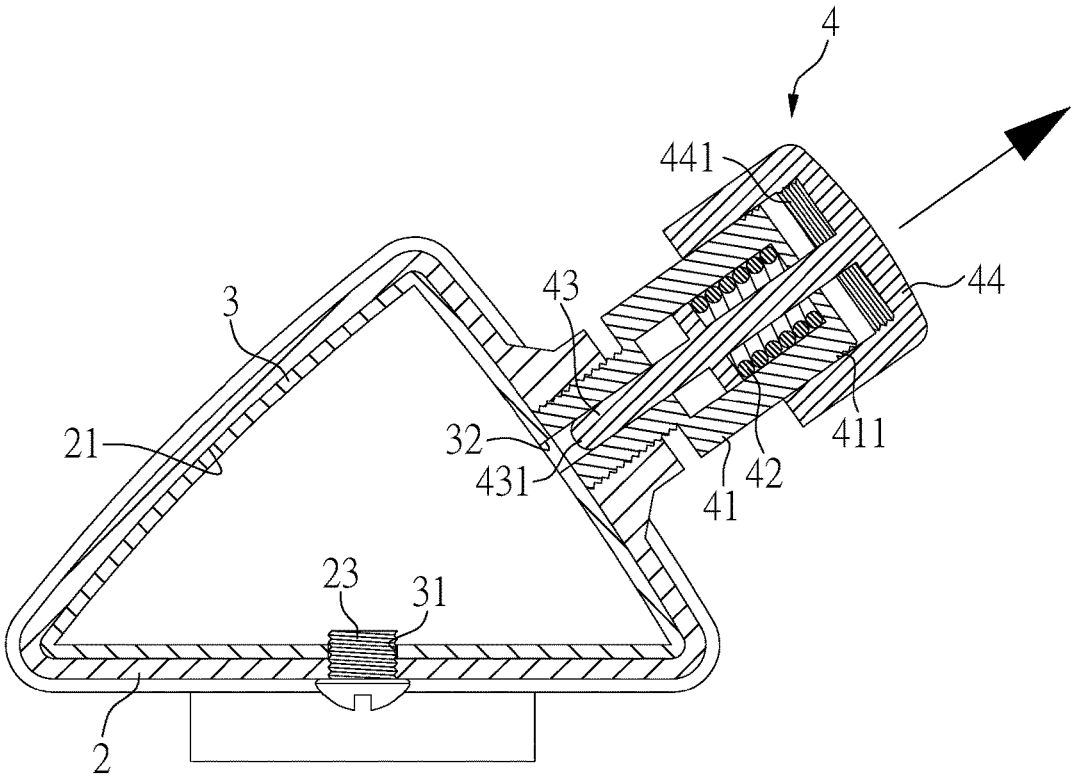
FIG. 5 is according to FIG. 3, showing that the positioning pin is pulled away from a positioning hole by an unscrewed and outward-pulled knob.

When the elliptical exerciser of the embodiment as described previously is to be put in use, if the two extension legs 3 are retracted with respect to the stationary seat 2 and are retained by the positioning pins 4, a user can unscrew the knobs 44 from the trunk 41, and pull the pins 43 until their end portions 431 leave the corresponding positioning holes 32 (as shown in FIG. 5), so as to enable extension of the two extension legs 3 with respect to the stationary seat 2. After this operation, the user can release the pins 43 and let the end portions 431 engage with another set of the positioning holes 32 corresponding to the extended state (as shown in FIG. 3). Then the knob 44 is again screwed to the trunk 41, thereby allowing the frame 1 to stand on the extension base stably.

Figure 6:
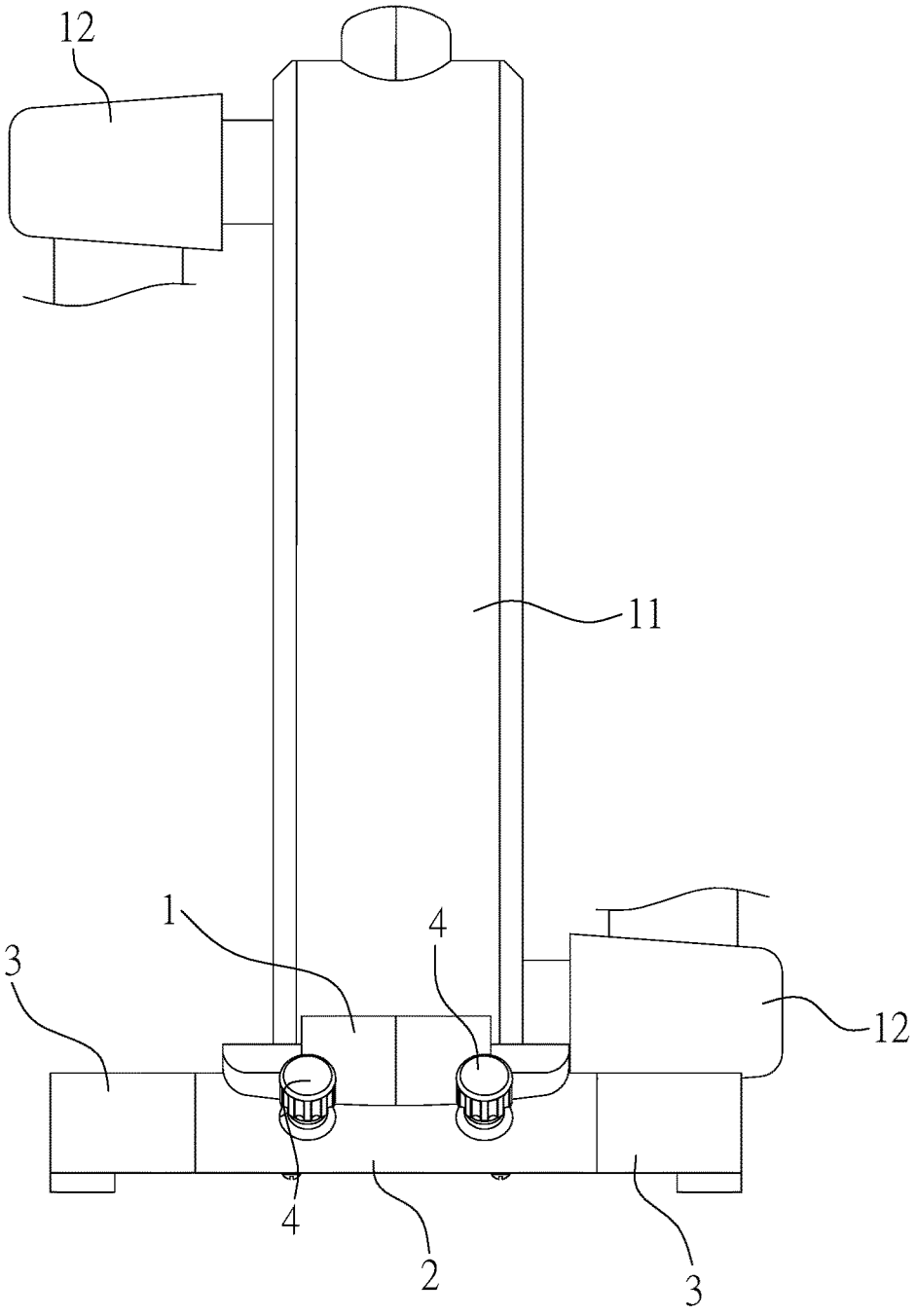
FIG. 6 is a plane view of the extension base of the first embodiment of the present invention wherein the extension legs are fully retracted into the stationary seat.

To store the elliptical exerciser back to its packaging case, the user can once again unscrew the knobs 44 from the trunks 41, and pull the pins 43 until their end portions 431 leave the positioning holes 32 they engaged (as shown in FIG. 5), before retracing the two extension legs 3 with respect to the stationary seat 2. Then when the pins 43 are released, the end portions 431 once again engage with the positioning hole 32 corresponding to the retracted state (as shown in FIG. 3). At this time, the distance between the outer ends of the two extension legs farthest away from each other is retracted to its minimum (as shown in FIG. 6), yet still long enough to support the elliptical exerciser and prevent it from falling, so as to prevent the elliptical exerciser standing in the case from rollover.

Thus, the advantages of the present invention are clear. The two extension legs 3 are capable of being extended or retracted with respect to the stationary seat 2. When extended, the extension base supports the exercise apparatus to stand upright stably. When the exercise apparatus is packed in its packaging case for the manufacturer's shipment or the user's storage, unlike the prior-art devices where removal and later reassembly of the base are required, the extension base of the present invention can be easily retracted by retracting the two extension legs 3 with respect to the stationary seat 2. This eliminates repeated operations for assembly and disassembly, thereby enabling convenient shipment. More important, the retracted extension base still support the exercise apparatus competently, so as to prevent the exercise apparatus standing upright in the packaging case from rollover. This is useful to prevent accident damages of the exercise apparatus and people therearound.

Figure 7:
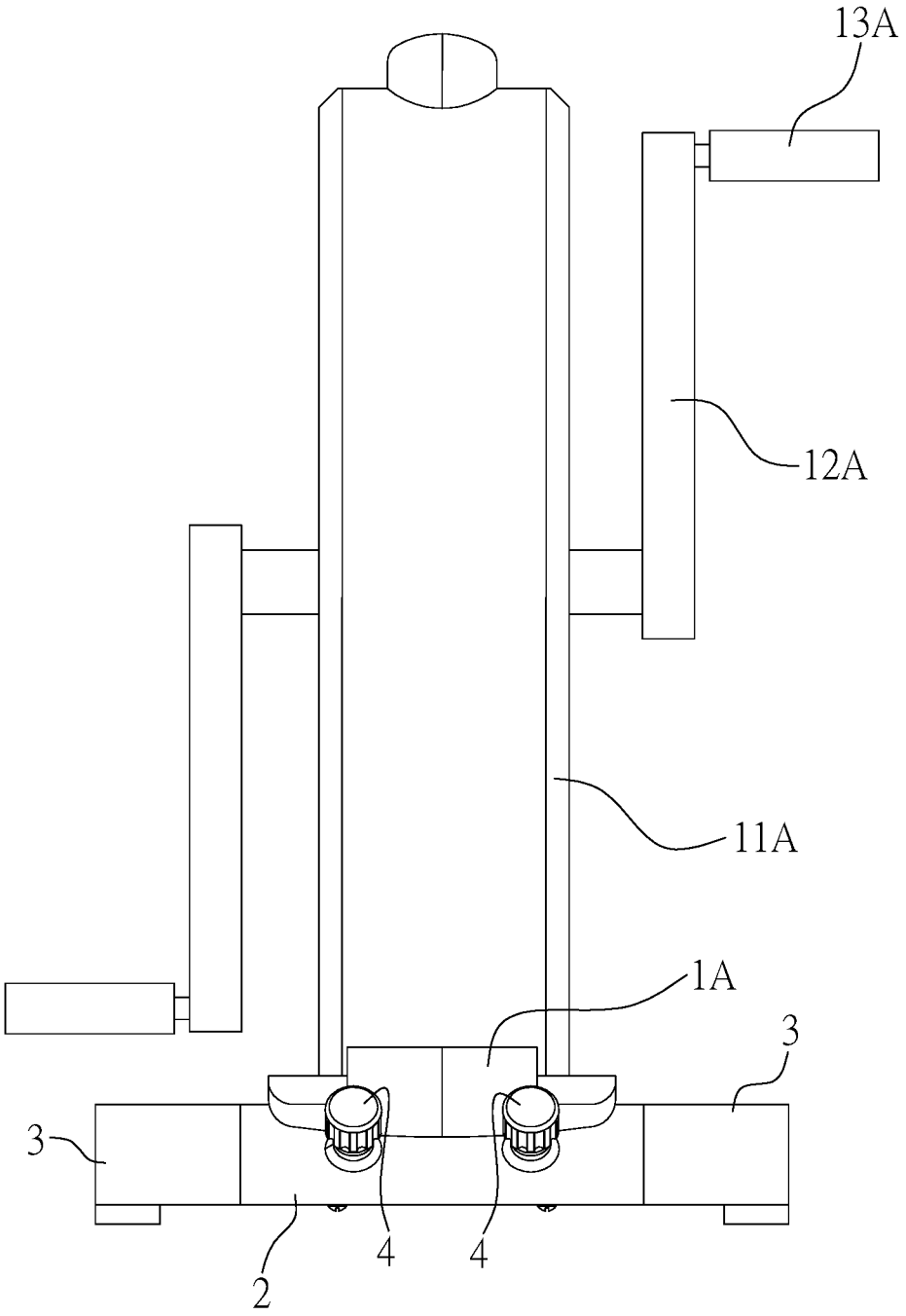
FIG. 7 is a plane view of the extension legs fully retracted into the stationary seat according to a second embodiment of the present invention.
Figure 8:
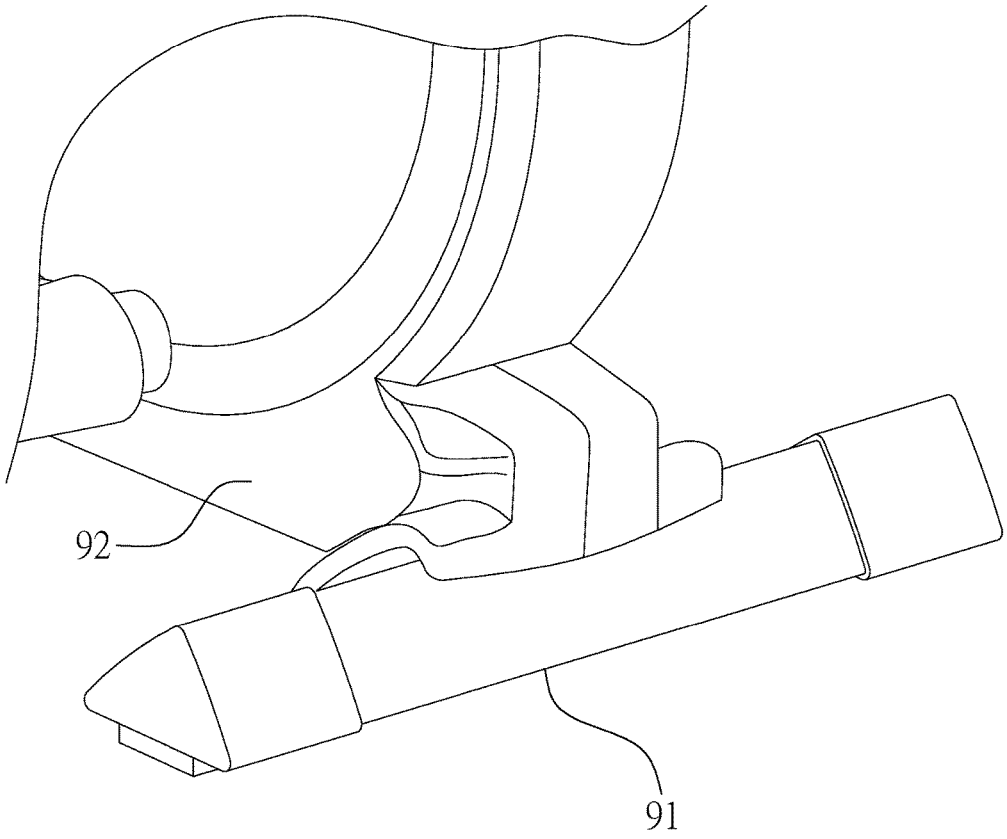
FIG. 8 PRIOR ART
FIG. 8 is a perspective view of a conventional base of an elliptical exerciser.

Of course, many examples of implementation of the present invention exist with only minor differences therebetween. Referring to FIG. 7, the second embodiment of the present invention is different from the first embodiment as it is applied to a conventional exercise bike. The exercise bike has a frame 1A carrying a flywheel 11A for providing loading, and two treadles 13A connected to the flywheel 11A from two sides through respective cranks 12A. Since the cranks 12A laterally extends more than the cranks 12 of the first embodiment, the distance between the outer ends of the two treadles 13A farthest away from each other is longer than that between the two treadles 13 of first embodiment. When the exercise bike is packed in its packaging case, the case has a width at least equal to the distance between the outer ends of the two treadles 13A.

As shown, according to the present embodiment, when the two extension legs 3 are fully retreated into the stationary seat 2, a distance between the outer ends of the two extension legs farthest away from each other is smaller than or equal to the distance between the outer ends of the two treadles 13A. In the present embodiment, the former is smaller than the latter, so that when the exercise bike is placed into the packaging case, the base can be stored in the packaging case without problem while being also effective in supporting the exercise bike from rollover, thereby functioning as well as the first embodiment.

While the embodiments of the present invention are related to elliptical exercisers and exercise bikes, the disclosed structure is applicable to other exercise apparatuses have treadles for treading exercises, and all these applications are within the scope of the present invention.

What is claimed is:

1. An extension base for an exercise apparatus, the exercise apparatus having a frame that carries a flywheel for providing loading, and two treadles connected to the flywheel from two sides through respective cranks, so that when the two treadles are treaded, the flywheel provides resistance, and the extension base comprising:

a stationary seat, being attached to a bottom of the frame, and being of a tubular structure that has a channel and has openings at two ends of the channel; and two extension legs, each having an appropriate length and being inserted into the channel from the two openings, respectively, so that the extension legs can be symmetrically extended and retracted with respect to the stationary seat, wherein when the extension legs are fully retracted into the stationary seat, a distance between outer ends of the two extension legs farthest away from each other is still long enough to support an elliptical exerciser and prevent the elliptical exerciser from falling, each of the extension legs has a slot in a segment thereof retractable into the channel, the slot extending in a direction parallel to a direction in which the extension leg moves, the stationary seat having two retaining portions corresponding to the slots of the extension legs, extension of the extension legs with respect to the stationary seat being limited by retaining portions moving in the slots, so as to prevent the extension legs from leaving the stationary seat.

2. The extension base of claim 1, wherein the distance between the outer ends of the two extension legs farthest away from each other when the extension legs are fully retracted into the stationary seat is smaller than or equal to a distance between outer ends of the two treadles farthest away from each other.

3. The extension base of claim 1, wherein the stationary seat has two positioning pins corresponding to the two extension legs inserted therein, and the positioning pins position the corresponding extension legs at an extended or retracted position of the extension legs so as to retain the extension legs to the stationary seat.

4. The extension base of claim 3, wherein each of the extension legs has a plurality of positioning holes formed therein, and each of the positioning pins is a pull pin, which comprises a trunk, a spring member contained in the trunk, and a pin biased by the spring member, in which the trunk is configured to be combined with the stationary seat and make the pin biased by the spring member push an end portion thereof into the channel, so that the pin is inserted in a selected one of the plurality of positioning holes of a corresponding one of the extension legs until the pin is pulled out and leaves the selected positioning hole.

5. The extension base of claim 4, wherein the trunk of each of the pins is externally combined with a knob, in which when the pin associated thereto is received in selected one of the plurality of positioning holes, the knob is configured to be screwedly engaged with the trunk so as to make the pin stay in the selected positioning hole and prevent the pin from unintentionally pulling up, and when the knob is unscrewed from the trunk, the pin is no longer be retained and can be pulled out.

* * * * *